US007671819B2

(12) United States Patent
van der Bilt

(10) Patent No.: US 7,671,819 B2
(45) Date of Patent: Mar. 2, 2010

(54) ANTENNA ASSEMBLY

(75) Inventor: Casper van der Bilt, Emmen (NL)

(73) Assignee: Sony Ericsson Mobile Communications AB, Lund (SE)

( * ) Notice: Subject to any disclaimer, the term of this patent is extended or adjusted under 35 U.S.C. 154(b) by 147 days.

(21) Appl. No.: 11/782,184

(22) Filed: Jul. 24, 2007

(65) Prior Publication Data

US 2009/0027296 A1 Jan. 29, 2009

(51) Int. Cl.
*H01Q 7/00* (2006.01)

(52) U.S. Cl. ..... 343/870; 343/741; 343/866

(58) Field of Classification Search ..... 343/866, 343/867, 870, 741, 742
See application file for complete search history.

(56) References Cited

U.S. PATENT DOCUMENTS 5,341,148 A 8/1994 Walter et al.
6,225,952 B1 5/2001 Harano

FOREIGN PATENT DOCUMENTS

| | | |
|---|---|---|
| EP | 1 032 075 A2 | 8/2000 |
| JP | 60-200626 | 10/1985 |
| JP | 8-195618 | 7/1996 |

OTHER PUBLICATIONS

International Search Report and Written Opinion dated Apr. 16, 2008 issued in corresponding PCT application No. PCT/EP2008/050690, 12 pages.

*Primary Examiner*—Hoang V Nguyen
(74) *Attorney, Agent, or Firm*—Harrity & Harrity, LLP

(57) ABSTRACT

An antenna assembly includes an antenna. The antenna assembly includes at least one interrupted loop or rod of electrically conducting material and a printed circuit board (PCB). At least a part of the PCB together with the at least one interrupted loop or rod of electrically conducting material forms the antenna.

23 Claims, 4 Drawing Sheets

ANTENNA ASSEMBLY

TECHNICAL FIELD

The present invention relates to an antenna assembly having an antenna for transmitting and/or receiving radio signals. The present invention also relates to a printed circuit board (PCB) for use in an antenna assembly and a radio communication device including such an antenna assembly or PCB.

BACKGROUND OF THE INVENTION

An antenna is a transducer designed to transmit and/or receive radio waves. That is, an antenna converts radio frequency electrical currents into electromagnetic waves and vice versa. Physically, an antenna is an arrangement of one or more electrical conductors that is arranged to generate a radiating electromagnetic field in response to an applied alternating voltage and the associated alternating electric current, or that can be placed in an electromagnetic field so that the field will induce an alternating current in the antenna and a voltage between its terminals.

Portable radio communication electronic devices, such as mobile phones, typically include an antenna that is connected to electrically conducting tracks or contacts on a printed circuit board by soldering or welding. Manufacturers of such electronic devices are under constant pressure to reduce the physical size, weight and cost of the devices and improve their electrical performance. This low cost requirement dictates that the electronic device and its antenna should be simple and inexpensive to manufacture and assemble. An antenna, such as a coil-type antenna, may however be quite complex, time-consuming and costly to manufacture. Soldering or welding an antenna to a printed circuit board may also be a complex, time-consuming and costly process, especially if antenna space is less than optimal. Furthermore, soldered and welded connections are prone to failure during the manufacture and use of the device. These failures (caused by vibration, shock, thermal or mechanical stress) result in higher manufacturing costs due to the higher number of rejects occurring during the manufacture of the devices and in higher costs due to warranty claims and customer dissatisfaction when the devices are in use.

SUMMARY OF THE INVENTION

Aspects of the invention provide an improved antenna assembly.

For example, exemplary aspects described herein provide an antenna assembly that includes at least one interrupted loop or rod of electrically conducting material, and a printed circuit board (PCB), wherein at least one part of the PCB together with the at least one interrupted loop or rod of electrically conducting material forms the antenna. In other words, only when the PCB is connected to the at least one interrupted loop/rod of electrically conducting material is the antenna formed. The at least one part of the PCB therefore constitutes an integral part of the antenna.

The expression "at least one interrupted loop or rod of electrically conducting material" is intended to mean at least one open conductor that does not form a complete loop or rod having the properties necessary to make the desired antenna. Such interrupted loops of electrically conducting material are easier to manufacture than a coil, for example, and an antenna comprising such interrupted loops is easy to assemble, since it may be assembled using mechanical pressure, rather than welding or soldering.

The expression printed circuit board, or PCB, is intended to mean any flexible or non-flexible, planar or non-planar, substantially non-electrically-conductive substrate that is used to mechanically support at least one microchip or other electronic component, and/or to electrically connect components supported thereon and/or connected thereto using conductive pathways etched/printed/engraved or otherwise provided thereon.

Furthermore, the words "antenna" and "aerial" are, in practice, used interchangeably; but usually a rigid structure is termed an antenna and a wire format is called an aerial. It should be noted that the expression "antenna", as used in this document, is intended to include both "antennas" and "aerials".

According to an exemplary embodiment, the antenna assembly comprises mechanical holding means, preferably releasable mechanical holding means, such as a spring-loaded or non-spring-loaded clip or a re-adherable adhesive strip, for holding said at least one part of the PCB in a position in which the antenna is formed. The expression "mechanical holding means" includes any conventional displacement-minimizing/preventing mechanism or locking mechanism other than soldering or welding. Since no soldering or welding is thus necessary, such an antenna assembly may be assembled simply, quickly and reliably, saving manufacturing time and costs. Additionally, when manufacturing such an antenna assembly, manufacturing tolerances need not be so high, as compared to antennas that are welded or soldered to a PCB, further reducing manufacturing time, complexity and costs.

According to another aspect, the antenna assembly includes a holder comprising dielectric material, such as a liquid crystal polymer (LCP) dielectric material or epoxy resin, in/on/around which the at least one interrupted loop/rod of electrically conducting material is arranged. The holder may comprise at least one slot to receive and/or hold at least one PCB, or at least one part of a PCB.

According to still another aspect, at least one part of the PCB is located on at least one side of the PCB.

According to another aspect, the antenna assembly comprises a plurality of interrupted loop/rods of electrically conducting material and the at least one part of the PCB is arranged to provide a short circuit between two loop/rods of electrically conducting material of said plurality of interrupted loop/rods.

Alternatively, the at least one part of the PCB is arranged to connect at least two loop/rods of electrically conducting material so that a charge can flow along the loop/rods of electrically conducting material. The at least one part of the PCB may comprise at least one electrically conducting track or contact, and/or an electric circuit and/or at least one electronic component, such as a resistor, an inductor or a capacitor. The at least one part of the PCB may therefore change the length of a loop/rod and/or it may modify the electrical properties of a loop/rod.

According to yet another aspect, the at least one electrically conducting track or contact and/or the at least one electronic component of the PCB comprises a spring contact for engaging the antenna in order to provide an electrical contact between the PCB and the antenna, whereby the spring contact also functions as a mechanical holding means. Alternatively or additionally, the at least one interrupted loop/rod of electrically conducting material comprises a spring contact for engaging the PCB in order to provide electrical contact between the at least one interrupted loop/rod of electrically conducting material and the PCB.

According to a further aspect, the antenna assembly comprises at least two interrupted loop/rods of electrically conducting material and a feeding section. The at least two interrupted loops of electrically conducting material and the at least one part of the PCB together form a coil-type antenna comprising at least two turns and a feeding section. The at least one part of the PCB provides a short circuit between the outermost turn of the coil-type antenna, i.e., the turn that is provided furthest from the feeding section of the coil-type antenna, and the turn adjacent to the outermost turn. It has been found that such an antenna assembly causes mass blocks in a radio communication device to transmit radio signals omni-directionally and efficiently. According to an exemplary embodiment, the short circuit is provided at the distal end of the outermost turn.

It should be noted that the antenna described above, when included in a small portable radio communication device, such as a mobile phone, may be referred to as an "antenna element" (and not an "antenna") because it may only partly contribute to the transmission or reception of the radio waves transmitted or received by the device. Other large, electrically conductive components of the device, such as its chassis, its battery or a printed circuit board also influence the transmission and/or reception of radio signals. The antenna element is capacitively and/or inductively coupled to the mass blocks in such a way that the complete antenna (i.e., the antenna element and the mass blocks) is provided with the desired impedance. Consequently, the component that is normally considered to be an "antenna" in fact functions as an exciter for such mass blocks and can therefore be designated an "antenna element" rather than an "antenna". The expression "antenna" in this document is, however, intended to include components that may be considered to be "antenna elements", in addition to components that may be considered "antennas".

The coil-type antenna described above may further comprise a return section connected to a distal end of the outermost turn and extending, inside or outside of the plurality of turns, towards the feeding section, in a direction substantially parallel with a central axis of the coil-type antenna.

According to an embodiment, the antenna comprises a feeding section and the PCB comprises components for radio frequency (RF) functionality and is arranged to be connected to the feeding section of the antenna. Alternatively, the PCB that forms part of the antenna does not comprise such components and the feeding section of the antenna assembly is instead arranged to be connected to a second PCB that does comprise components for radio frequency (RF) functionality.

Aspects described herein also relate to a printed circuit board for use in an antenna assembly according to any of the embodiments of the invention, whereby at least one part of the PCB comprises part of at least one loop/rod of electrically conducting material that is arranged to form part of an antenna comprising at least one loop/rod of electrically conducting material. Further details of such a printed circuit board are provided herein.

Aspects described herein further relate to a portable or non-portable radio communication device, such as a telephone, Personal Communications System (PCS) terminal, Personal Data Assistant (PDA), laptop computer, palmtop receiver, camera, television, radar or any appliance that includes a radio transmitter and/or receiver, comprising at least one antenna assembly or at least one PCB according to any of the embodiments of the invention.

Aspects described herein also relate to a method for assembling an antenna. The method comprises the step of inserting or attaching at least one part of a PCB according to any of the embodiments of the invention into/to at least one interrupted loop/rod of electrically conducting material. The at least one part of the PCB together with the at least one loop/rod of electrically conducting material form the antenna.

The present invention further relates to a method for assembling an antenna assembly having an antenna. The method comprises the step of inserting or attaching at least one part of a PCB according to any of the embodiments of the invention into/to at least one interrupted loop/rod of electrically conducting material. The at least one part of the PCB together with the at least one loop/rod of electrically conducting material form the antenna.

BRIEF DESCRIPTION OF THE DRAWINGS

The present invention will hereinafter be further explained by means of non-limiting examples with reference to the appended figures where.

It should be noted that the drawings have not been drawn to scale and that the dimensions of certain features have been exaggerated for the sake of clarity.

DETAILED DESCRIPTION OF EMBODIMENTS

Figure 1:
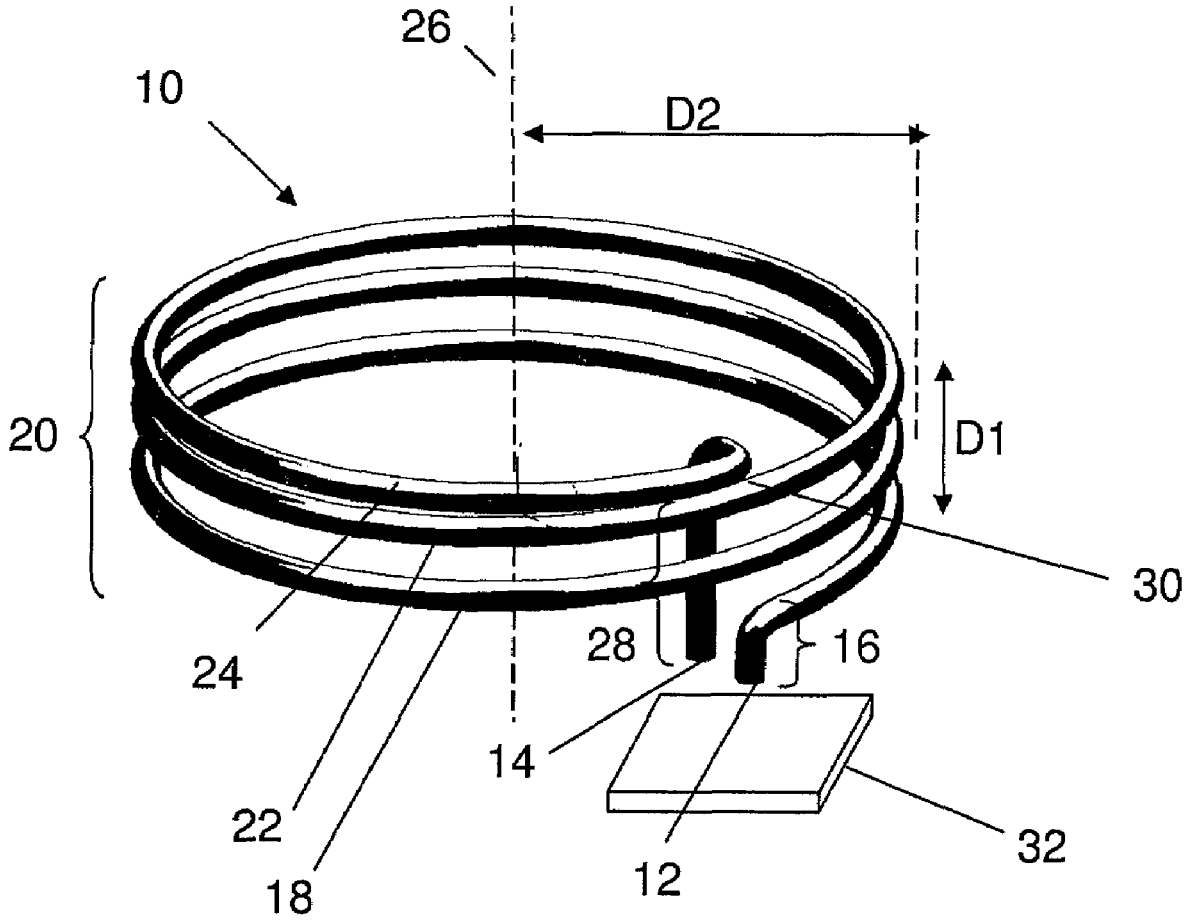
PRIOR ART Fig. 1
FIG. 1 illustrates a coil-type antenna according to the prior art.

FIG. 1 shows a perspective view of an antenna 10, namely a coil-type antenna, according to the prior art which is arranged to be provided inside a small portable radio communication device for example.

The illustrated antenna 10 comprises a wire of electrically conducting material. The wire has first 12 and second 14 feeding ends, constituting a feeding section, which are provided for connection to a PCB 32 that provides a radio communication unit and ground connection. The first feeding end 12 is provided in an input section 16 of the antenna 10 which extends in a substantially straight line and is connected to a first turn 18 of a winding section 20. The winding section 20 comprises a number of turns 18, 22, 24 of the wire wound around a central axis 26. The input section 16 extends in a direction parallel to the central axis 26 and is therefore connected at substantially a right angle to the winding section 20.

Part of the outermost turn 24 of the winding section 20, which is located furthest from the first feeding end 12, is in physical contact with the adjacent turn 22. The rest of the turns are separated from each other by gaps. In this way, the winding section 20 has a height D1, measured in the direction of the central axis 26, which is determined by the number of turns, the cross-sectional area of the wire and the gaps between the turns. All of the turns 18, 22 and 24 of the winding section 20 have a radius D2 measured from the central axis 26. The outermost turn 24 is, at its distal end, connected at an angle of approximately 90° to a return section 28, which extends towards and past the innermost turn 18 in a direction parallel to the central axis 26. The return section 28 is not in contact with any of the other turns of the antenna other than the outermost turn 24.

An area or point of contact 30 between the outermost turn 24 and the adjacent turn 22 is provided at the point where the outermost turn 24 is connected to the return section 28. Instead of the outermost turn 24 being in physical contact with the adjacent turn 22 at the area or point of contact 30, the outermost turn 24 could be soldered or welded to the adjacent turn 22 in this area or at this point. Furthermore, the return section 28 of the illustrated antenna is located inside the winding section 20. It could alternatively be located on the outside of the winding section 20.

The antenna 10 has low impedance along the central axis 26 from the top of the winding section 20 in a direction towards the top of the page and low impedance along the central axis 26 from the bottom of the winding section 20 towards the bottom of the page, typically of about 50 ohms (Ω). The antenna 10 also has high impedance from the winding section 20 in a radial direction from the central axis 26. Such an antenna 10 is therefore beneficial to use but may be complex, time-consuming and costly to manufacture and assemble.

Figure 2:
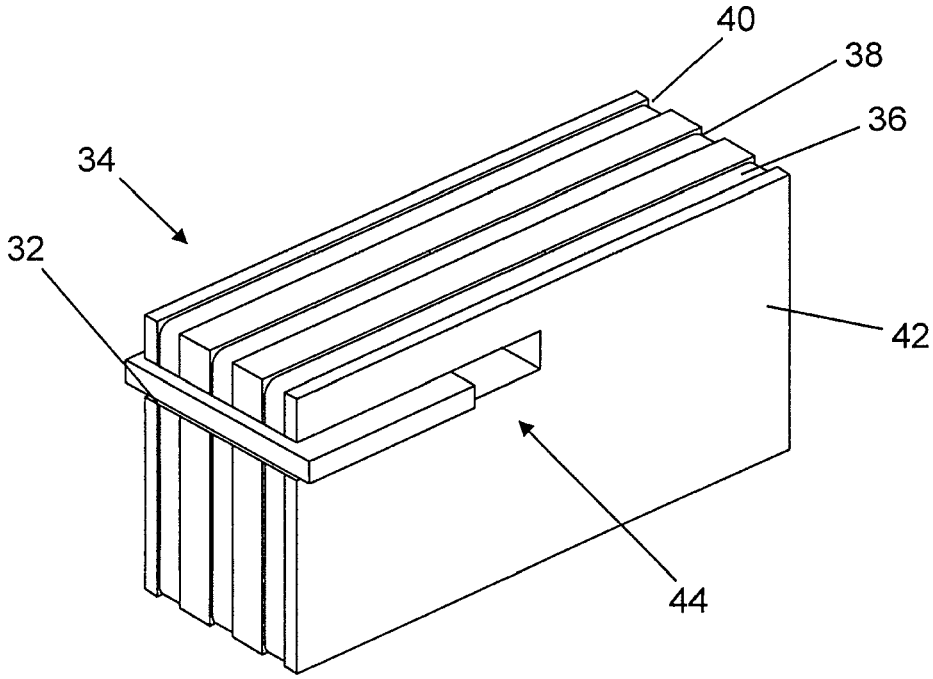
FIGS. 2-4 illustrates an antenna assembly according to an exemplary embodiment.

FIG. 2 illustrates an antenna assembly 34 according to a first exemplary embodiment of the invention. The antenna assembly 34 includes three interrupted loops of electrically conducting material 36, 38, 40 and a printed circuit board (PCB) 32. The three interrupted loops of electrically conducting material 36, 38, 40 are arranged around the outside of a holder 42 comprising dielectric material. The holder 42 is exemplified as a rectangular block comprising channels to accommodate the three interrupted loops of electrically conducting material 36, 38, 40 around its outer surface. The holder 42 may of course be of any shape and size and may be arranged to accommodate any number of interrupted loops of electrically conducting material 36, 38, 40 varying in length, spacing and orientation, in, on or around any part thereof. The electrically conducting material may, for example, be arranged to be at least partly embedded in the dielectric material of the holder 42.

The PCB 32 is inserted into a slot 44 in the holder 42 and is preferably locked in place by mechanical holding means (not shown). When the PCB 32 has been inserted into the slot 44, part of it, together with the three interrupted loops of electrically conducting material 36, 38, 40, form an antenna equivalent to the coil-type antenna 10 shown in FIG. 1 (although the electrically conducting material and the antenna illustrated in FIG. 2 have a rectangular cross section rather than a circular or elliptical cross section as shown in FIG. 1). The electrically conducting material, the holder 42 and the winding section 20 may of course be of any cross section.

It is the inserted PCB 32 that electrically connects, and thus completes, the individual interrupted loops of electrically conducting material 36, 38, 40 to make a coil and thus the antenna. The inserted PCB 32 also provides a short circuit between the outermost loop 40 and the adjacent loop 38 of the coil.

According to an exemplary aspect, the inserted PCB 32, as well as completing the antenna, may also provide the antenna with a feeding section, comprise components for radio frequency (RF) functionality and be arranged to be connected to the feeding section. Alternatively, a feeding section may be provided as part an interrupted loop of electrically conducting material 36 which is then connected to the inserted PCB 32 or a second PCB (not shown). The second PCB could of course be connected to the antenna in the same way as the PCB 32 in FIG. 2 or in any other way.

Figure 3:
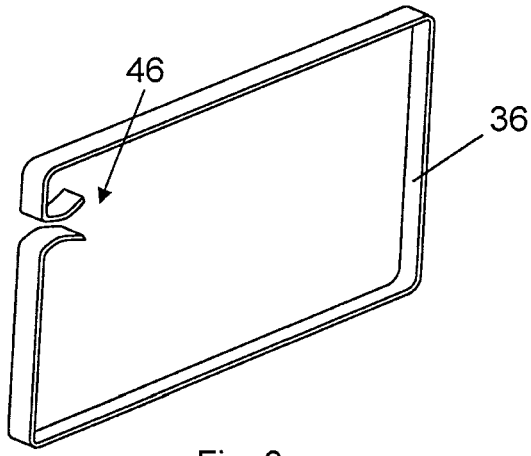

FIG. 3 shows an interrupted loop of electrically conducting material that comprises a spring contact 46 for engaging the PCB 32 in order to provide electrical contact between an electrically conducting track or contact on the PCB 32 and itself. Alternatively, or additionally, a spring contact 46 could be arranged on the holder 42 and/or on an electrically conducting or non-electrically conducting part of the PCB 32 as a mechanical holding means to hold the PCB 32 in place. Electrical contact between a PCB 32 and at least one interrupted loop of electrically conducting material 36, 38, and 40 may also be established using mechanical pressure. Mechanical robustness is thus achieved through the elasticity of the materials constituting the antenna assembly and the friction between its constituent parts.

Figure 4:
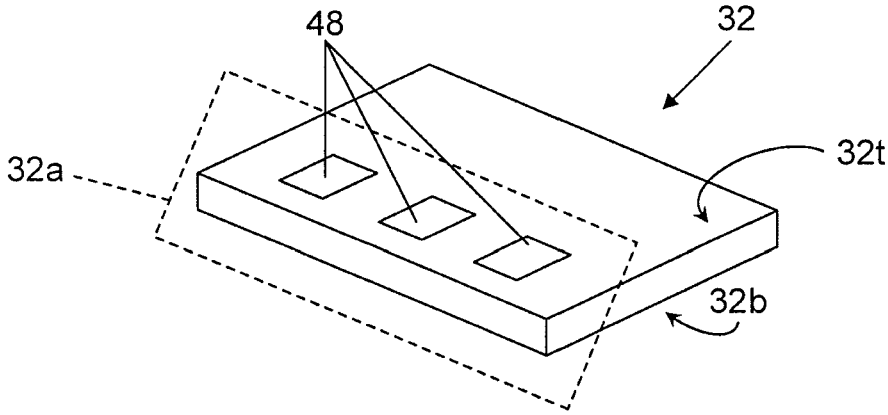

FIG. 4 shows a PCB 32, a part 32*a* of which includes at least one of the following features 48: an electrically conducting track or contact and/or an electronic component located on both the top 32*t* and bottom side 32*b* of the PCB 32, whereby the at least one feature 48 constitutes an integral part of the antenna. The at least one feature 48 could of course be located on only one side, or edge of the PCB 32. Furthermore, two or more parts of the PCB 32 could arranged to be inserted into or attached to at least one interrupted loop of electrically conducting material 36, 38, 40. Alternatively, a plurality of PCBs could be arranged to be inserted into, or attached to at least one interrupted loop of electrically conducting material 36, 38, and 40.

Figure 5:
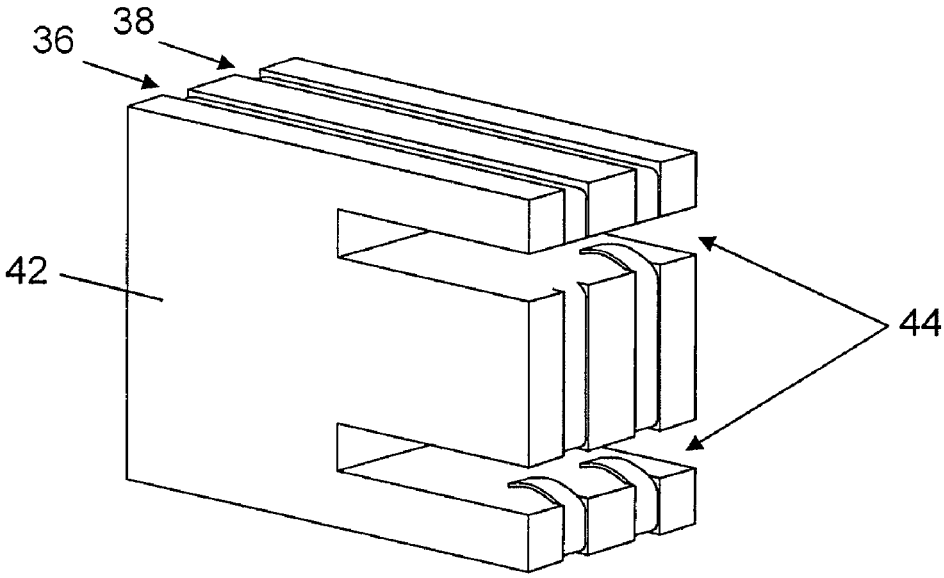
FIGS. 5-8 illustrate an antenna assembly according to another exemplary embodiment.
Figure 6:
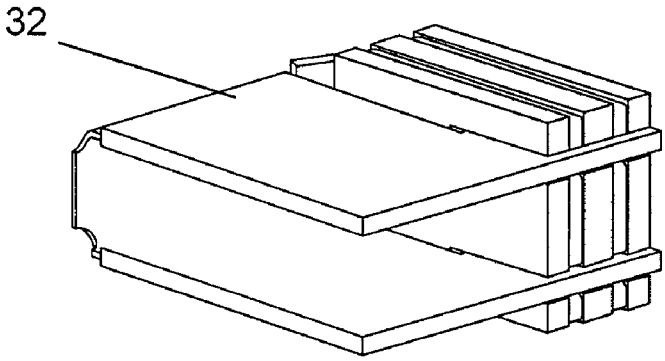
Figure 7:
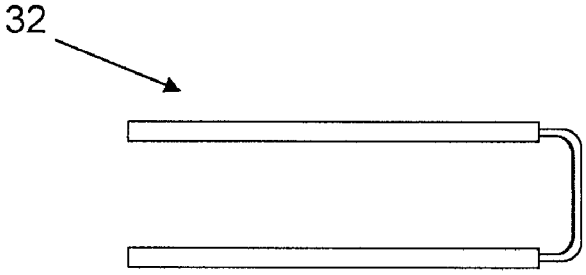
Figure 8:
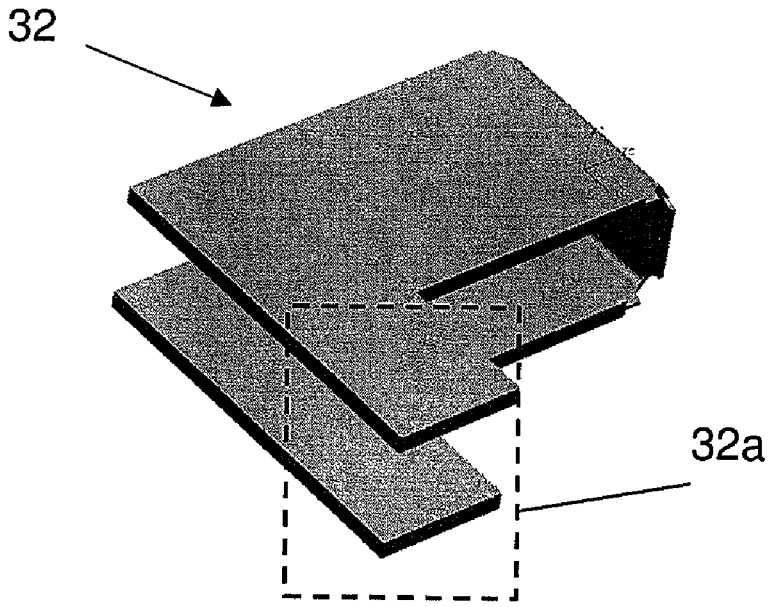

It should be noted that the PCB 32 could comprise flexible material allowing it to be bent, into a U-shape for example, before it is connected to at least one interrupted loop of electrically conducting material 36, 38, and 40. For example, FIG. 5 shows a holder 42 around which two interrupted loops of electrically conducting material 36 and 38 are arranged. The holder 42 comprises two slots 44 into which a PCB 32 is inserted (as shown in FIG. 6). The PCB 32 may itself comprise a conducting loop (not shown) that is to form part of a coil-type antenna comprising three conducting loops. The PCB 32 adopts a U-shape when it has been inserted into the holder 42 (as shown in the side view of the PCB 32 in FIG. 7). It should be noted that the PCB 32 may alternatively be rigid and have a U-shaped form, as shown in FIG. 8.

Figure 9:
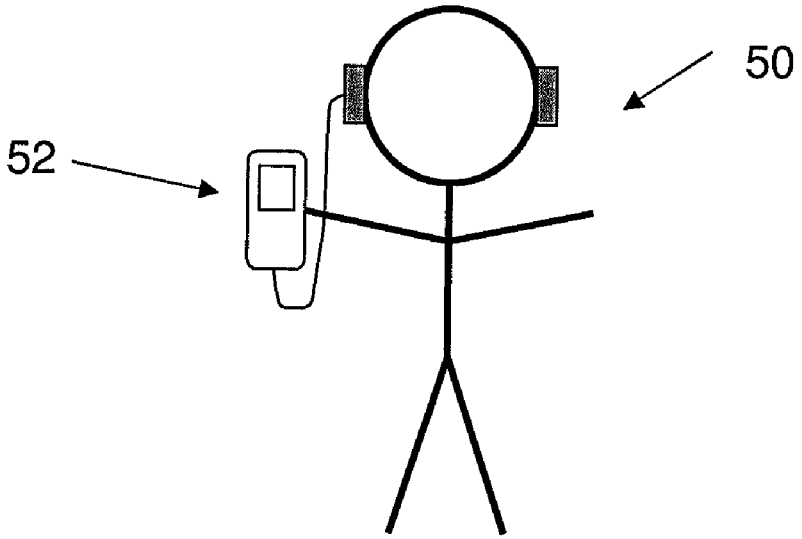
FIG. 9 illustrates a user with a portable radio communication device according to an embodiment.

FIG. 9 shows a user 50 holding a small portable radio communication device 52, namely a mobile phone, comprising an antenna assembly according to any of the exemplary embodiments described herein. Mobile phones 52 generally exchange radio signals with a base station. Some signal exchange occurs when the mobile phone 52 is on standby and no telephone call is being made and the mobile phone 52 is located for instance in the hand, in a pocket, at the waist of a user 50 or on a string around the neck of the user 50. Signal exchange also occurs while a telephone call is being made or received and the mobile phone 52 is then typically located between the ear and mouth of the user 50, or in a pocket or at the waist of the user 50 with a headset or an earpiece and a microphone connected.

If an antenna is located close to the body of a user 50, this decreases the efficiency of the antenna since the human body is effective in absorbing radio energy and de-tuning the mobile phone's internal antenna. However, by using an omnidirectional antenna, such as the one shown in FIGS. 1, 2 and 6, radiation will be radiated away from the body of the user 50 at all times irrespective of the location or orientation of the antenna in relation to the user 50, since both the antenna or exciter and at least one of the mobile phone's mass blocks are provided as three-dimensional structures.

The antenna used in such a wireless radio communication device 52 needs to be very small if the device 52 uses short-range high frequency communication, such as Bluetooth™ communication protocol, while at the same time being able to operate within a particular frequency band (of around 2.45 GHz or higher in the case of Bluetooth™). Using an antenna assembly and assembly method according to an embodiment of the invention is therefore particularly beneficial in devices using short-range high frequency communication.

The foregoing description of the embodiments provides illustration and description, but is not intended to be exhaustive or to limit the invention to the precise form disclosed. Modifications and variations are possible in light of the above teachings or may be acquired from practice of the invention. For example, further modifications of the invention within the scope of the claims would be apparent to a skilled person.

It should be emphasized that the term "comprises/comprising" when used in this specification is taken to specify the presence of stated features, integers, steps, or components, but does not preclude the presence or addition of one or more other features, integers, steps, components, or groups thereof.

The scope of the invention is defined by the claims and their equivalents.

What is claimed is:

1. An antenna assembly having an antenna, where said antenna assembly comprises:

at least one interrupted loop or rod of electrically conducting material;

a printed circuit board (PCB), where at least one part of the PCB together with said at least one interrupted loop or rod of electrically conducting material forms said antenna; and a holder formed on or around said at least one interrupted loop or rod of electrically conducting material, where said holder comprises a dielectric material and a slot to accommodate the PCB or at least a portion of the PCB.

2. The antenna assembly according to claim 1, further comprising:

a mechanical holding means for holding said at least one part of the PCB in a position in which the antenna is formed.

3. The antenna assembly according to claim 1, where said at least a part of the PCB is located on at least one side of the PCB.

4. The antenna assembly according to claim 3, where said at least one interrupted loop or rod of electrically conducting material comprises a plurality of interrupted loops or rods of electrically conducting material and said at least one part of the PCB is arranged to provide a short circuit between two loops or rods of electrically conducting material of said plurality of interrupted loops or rods.

5. The antenna assembly according to claim 4, where said at least one part of the PCB is arranged to connect at least two loops of electrically conducting material.

6. The antenna assembly according to claim 1, where said at least one part of the PCB comprises:

at least one electrically conducting track or contact, and an electric circuit or at least one electronic component.

7. The antenna assembly according to claim 6, where said at least one electrically conducting track or contact or said electric circuit or at least one electronic component of the PCB comprises a spring contact for engaging the antenna in order to provide electrical contact between the PCB and the antenna.

8. The antenna assembly according to claim 1, where said at least one interrupted loop or rod of electrically conducting material comprises a spring contact for engaging the PCB in order to provide electrical contact between said at least one interrupted loop or rod of electrically conducting material and the PCB.

9. The antenna assembly according to claim 1, where the at least one interrupted loop or rod comprises at least two interrupted loops of electrically conducting material and a feeding section, the at least two interrupted loops of electrically conducting material and said at least one part of the PCB together forming a coil-type antenna comprising at least two turns, where said at least one part of said PCB provides a short circuit between an outermost turn of the coil-type antenna and a turn adjacent to said outermost turn.

10. The antenna assembly according to claim 9, where said short circuit is provided at a distal end of said outermost turn.

11. The antenna assembly according to claim 10, where said coil-type antenna further comprises:

a return section connected to the distal end of said outermost turn and extending inside or outside of said at least two turns towards said feeding section and in a direction substantially parallel with a central axis of said coil-type antenna.

12. The antenna assembly according to claim 1, further comprising:

an antenna feeding section, where the PCB comprises radio frequency components and connects to said antenna feeding section.

13. The antenna assembly according to claim 1, where said antenna assembly connects to a second PCB that comprises radio frequency components for radio frequency functionality and connects to a feeding section of said antenna.

14. A printed circuit board (PCB) for use in an antenna assembly comprising at least one interrupted loop or rod of electrically conducting material, the PCB comprising:

a first part comprising a portion of the at least one loop or rod of electrically conducting material that is arranged to form a part of the antenna assembly, and where the antenna assembly includes a holder formed on or around said at least one interrupted loop or rod of electrically conducting material, where said holder comprises a dielectric material and a slot to accommodate the PCB or at least a portion of the PCB.

15. The PCB of claim 14, where said first part of the PCB is located on at least one side of the PCB.

16. The PCB of claim 15, where said first part of the PCB is arranged to provide a short circuit between two loops or rods of electrically conducting material of the antenna assembly.

17. The PCB of claim 16, where said first part of the PCB is arranged to connect at least two loops or rods of electrically conducting material.

18. The PCB of claim 17, where said first part of the PCB comprises:

at least one electrically conducting track or contact, and an electric circuit or at least one electronic component comprising one or more of:

a resistor, an inductor, or a capacitor.

19. The PCB of claim 18, where said first part of the PCB comprises:

a spring contact for engaging an antenna to provide an electrical contact between the PCB and the antenna.

20. The PCB of claim 19, further comprising:

radio frequency components, where the first part connects to a feeding section of the antenna assembly.

21. A radio communication device, comprising:

at least one of a radio transmitter or a radio receiver;

at least one interrupted loop or rod of electrically conducting material;

a printed circuit board (PCB), where at least a portion of the PCB together with said at least one interrupted loop or rod of electrically conducting material forms at least part of an antenna; and a holder formed on or around said at least one interrupted loop or rod of electrically conducting material, where said holder comprises a dielectric material and a slot to accommodate the PCB or at least a part of the PCB.

22. The radio communication device of claim 21, where the radio communication device comprises at least one of a telephone, a Personal Communications System (PCS) terminal, a Personal Data Assistant (PDA), a laptop computer, a palmtop receiver, a camera, a television, or a radar device.

23. A method for assembling an antenna or an antenna assembly including an antenna, comprising:

inserting or attaching at least one part of a printed circuit board (PCB) to at least one interrupted loop or rod of electrically conducting material, where the at least one part of the PCB together with said at least one interrupted loop or rod of electrically conducting material form the antenna; and forming a holder on or around said at least one interrupted loop or rod of electrically conducting material, where said holder comprises a dielectric material and at least one slot to accommodate the PCB or at least a portion of the PCB.

* * * * *